United States Patent [19]

Auer

[11] 3,935,405

[45] Jan. 27, 1976

[54] MOUTH HELD SWITCH ASSEMBLY

[75] Inventor: William F. Auer, Des Plaines, Ill.

[73] Assignee: Willmark Products Company, Rosemont, Ill.

[22] Filed: Jan. 10, 1975

[21] Appl. No.: 539,979

[52] U.S. Cl. ..... 200/52 R; 200/61.58 R; 200/85; 200/165; 200/DIG. 2; 128/359

[51] Int. Cl.[2] ..... H01H 35/00

[58] Field of Search ..... 200/52 R, 61.5 R, 83 R, 200/85 A, 86 R, 165, DIG. 2; 3/1.1, 128; 128/41, 359, 360, 409, 418; 32/17–19; 173/30; 340/421

[56] References Cited

UNITED STATES PATENTS

| | | | |
|---|---|---|---|
| 1,043,755 | 11/1912 | Christianson | 200/DIG. 2 |
| 3,115,139 | 12/1963 | Schneider | 128/359 |
| 3,130,725 | 4/1964 | Griesinger | 128/360 |
| 3,349,489 | 10/1967 | Shackelford | 340/421 X |
| 3,584,169 | 6/1971 | Leu | 200/85 R |
| 3,795,281 | 3/1974 | Cloron | 200/52 R X |

*Primary Examiner*—James R. Scott
*Attorney, Agent, or Firm*—Kinzer, Plyer, Dorn & McEachran

[57] ABSTRACT

A mouth held switch assembly which is adapted to be connected to an electrically actuated surgical implement. The switch assembly is designed to be operated only by a clamping movement of the front incisors of the user. The switch assembly includes an elongated, thin walled, L-shaped, tubular housing, one end of which fits into the mouth of the user. A pair of electrical contacts formed on spaced blades are sealed in the leg of the housing which is insertable in the user's mouth. The contacts are connected to electrical leads extending out of one end of the housing. A portion of the housing is weakened adjacent the contacts with the weakened portion being protected by guards which permit only the incisor teeth of the user to contact the weakened portion of the housing, when the housing is inserted in the user's mouth. When the user bits down on the weakened portion of housing, the contacts are closed, thereby actuating the surgical implement.

7 Claims, 3 Drawing Figures

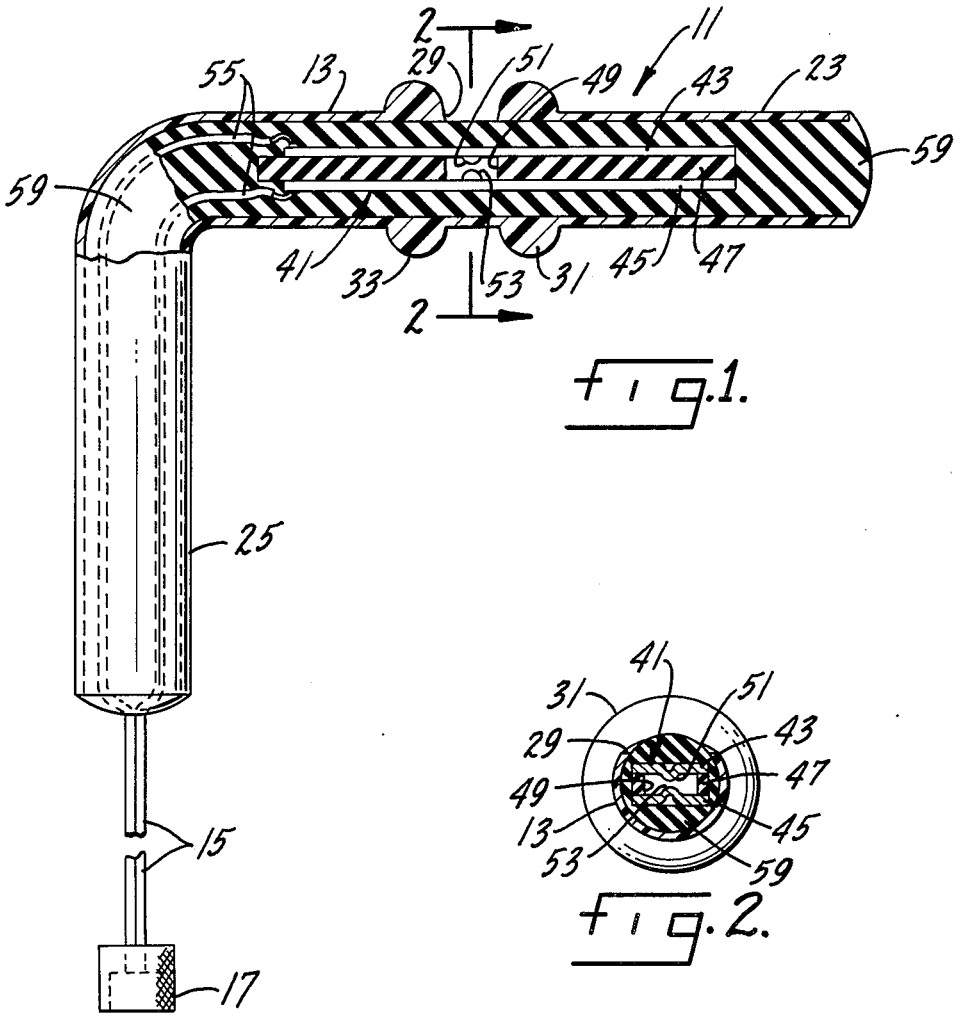
fig. 1.
fig. 2.
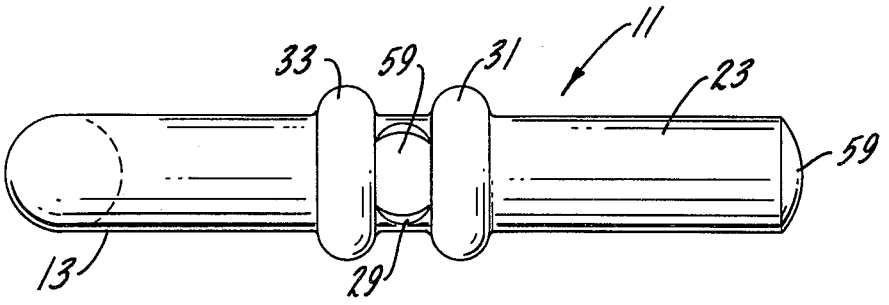
fig. 3.

MOUTH HELD SWITCH ASSEMBLY

SUMMARY OF THE INVENTION

This invention is concerned with a mouth held electrical switch assembly and more particularly with an electrical switch assembly that can be actuated only by a clamping action of the front incisors of the user.

An object of this invention is a mouth held electrical switch assembly for an electrically actuated surgical implement.

Another object is a mouth held electrical switch that is difficult, if not impossible, to actuate accidentally.

Another object is a mouth held switch for actuating an electrically operated surgical instrument which is particularly adaptable for use with electrical high frequency cutting implements used in surgical procedures in the human body.

Other objects and advantages of this invention may be found in the following specification, claims and drawings.

BRIEF DESCRIPTION OF THE DRAWINGS

The invention is illustrated more or less diagrammatically in the following drawings wherein:

FIG. 1 is a side elevational view of the mouth held electrical switch assembly of the invention with some portions broken away and other portions shown in cross-section;

FIG. 2 is a cross-sectional view taken along line 2—2 of FIG. 1; and

FIG. 3 is a top plan view of the electrical switch assembly of FIG. 1.

DESCRIPTION OF THE PREFERRED EMBODIMENT

A mouth held electrical switch assembly 11 embodying the novel features of this invention is shown in the drawings. The switch assembly includes a housing 13 having insulated electrical conductors or leads 15 extending from one end of the housing and an electrical connector 17 attached to the ends of the insulated conductors. In the preferred form of the invention, and as shown in the drawings, the connector 17 is of the push-fit female type. However, it should be understood that other types and designs of connectors may be used. The insulated conductors 15 are insulated with either plastic or rubber compositions, as manufacturing and operating considerations dictate. Since the switch assembly of this invention is intended to be connected to an electrically actuated surgical implement and particularly to a high frequency cutting implement, the connectors 17 will be designed to properly connect to an implement of this type.

The housing 13 is a hollow elongated tube in the shape of an L and having a generally circular cross-section. The housing preferably is formed of a suitable flexible, resilient plastic. The L shaped housing includes an actuating portion 23 which fits in the mouth of the user and a handle portion 25 extending at right angles to the mouth portion. An arcuate depression 29 is formed by cutting away a piece of the mouth portion 23 with the depression being located a predetermined distance from the free end of the mouth portion. This arcuate depression extends only partially around the circumference of the housing. Ribs 31 and 33 are formed in the housing on opposite sides of the depression. The ribs function as guards for the depression.

An electrical switch 41 is positioned inside the mouth portion 23 of the housing. The electrical switch includes elongated blades 43 and 45 of the electrical conductive material which are mounted on opposite sides of a compressible, resilient, insulating material 47. An opening 49 extends through the insulating material and contacts 51 and 53 located respectively on blades 43 and 45 are positioned to extend into the opening 49 in alignment with each other. The contacts 51 and 53 are also aligned with the depression 29 in the housing 13. The blades 43 and 45 are oriented relative to the depression 29 so that forces applied to the depression will move the blades towards each other and bring about an engagement of the contacts 51 and 53.

As is shown most clearly in FIG. 2, the contacts 51 and 53 may be projections formed as integral parts of the blades 43 and 45. Electrical wires 55 are connected to the blades 43 and 45, and extend through the handle portion 25 of the housing where they exit from the housing and become the insulated leads 15. The housing 13 is filled with a suitable, flexible insulating material such as rubber 59. The free ends of the mouth portion 23 and the handle portions 25 are closed in any suitable manner to seal the housing and thereby render it waterproof and shockproof.

The use, operation and function of this invention are as follows:

In recent years more and more surgeons have been using high frequency electrodes to do the actual cutting during surgical procedures. Most of the surgical procedures are performed inside a body cavity and, therefore, precision is extremely important. Presently, the most common device for controlling the actuation of the high frequency electrodes is a foot switch, although finger actuated switches are also used. However, a foot switch presents many disadvantages. For example, when the surgeon is required to use a foot switch for actuating high frequency electrodes, he is off balance because, in effect, he is standing on only one foot. This unbalancing can lead to a lack of precision in his cutting technique and could result in serious error and injury to the patient. Additionally, because the surgeon must use his foot to actuate the switch, the response of the cutting implement is not as immediate as is necessary in some precision cutting operations inside the body cavity. Also, when using a foot switch, the surgeon may be inconvenienced by the necessity to search for the switch with his foot so that he will be able to keep his eyes focused on the cutting area. Further, both foot and finger actuated switches are subject to accidental actuation.

The switch assembly 11 of this invention overcomes many of the disadvantages and drawbacks of foot and hand operated switches for controlling electrically operated surgical instruments, especially high frequency electrodes used for surgery. The switch assembly 11 permits the surgeon to accurately and rapidly energize and de-energize an electrically operated surgical instrument. In use, the mouth portion 23 of the housing 13 is inserted in the surgeon's mouth. When he wishes to actuate the electrode of his surgical instrument, he bites down with his front incisors on the depressed portion 29 of the housing. This clamping action of the teeth and jaw of the surgeon moves the blades 43 and 45 and their contacts 51 and 53 together to complete an electrical circuit through the electrical wires 55 and the electrical leads 15, thereby actuating whatever surgical implement is connected to the connector 17.

The ribs 31 and 33 perform the dual function of indicating to the surgeon where he should position his incisor teeth to actuate the switch and also protects against accidental actuation of the switch. The switch can be actuated only by moving the blades 43 and 45 towards each other. Thus, only forces exerted along an axis normal to the plane of the blades will be effective to bring the contacts 51 and 53 into circuit closing engagement. Thus, actuating force to close the switch can only be applied along an axis extending through the arcuate depression 29 formed in the housing. The ribs 31 and 33 limit the direction of the forces applied on this axis to a plane located between the ribs and essentially to that plane located on a diameter normal to axis of the housing. Since the depression 29 is limited in its arcuate extent, the portion of the plane through which forces can be effectively applied to actuate the switch 41 is quite limited. The arcuate depression 29 not only forms a portion of weakness in the housing which permits forces applied thereto to act upon the blades 43 and 45, but it also functions to indicate to the user the position to apply his incisors to actuate the switch 41. The handle portion 25 of the housing 21 enables the surgeon to pick up and properly position the switch assembly in his mouth. The switch assembly 11 is completely sealed by the rubber-like filler material 59 and, therefore, is shock and waterproof.

Whereas, a preferred form of the invention has been shown and described, it should be understood that there are many modifications, changes and alterations which can be made to the preferred embodiment without departing from the spirit of the invention. Therefore, the scope of the invention should limited only by a broad interpretation of the claims appended hereto.

I claim:

1. A mouth held switch assembly for actuating an electrically operated surgical instrument, which switch can be operated only by clamping movement of the front incisors of the user, said switch assembly including:

an elongated tubular housing having a handle portion and a actuating portion, electrical leads extending out of said handle portion of said housing, connecting means at the free ends of said electrical leads for connection to a surgical instrument, an electric switch having a pair of blades is positioned in said actuating portion of said housing and extends lengthwise thereof with each of said blades connected to an electrical lead of said switch assembly, said blades being mounted in spaced relationship to each other for movement towards and away from each other, contacts carried by the blades and engagable with each other upon movement of the blades toward each other, a transversely extending weakened area formed and located in said actuating portion of said housing adjacent said contacts to permit force applied to said weakened area of said housing to move said conductors towards each other, said weakened area of said housing being spaced from the end of the actuating portion of said housing a distance such that the front incisors of the user can engage said weakened area when said actuating portion is held in the user's mouth, and guards formed as parts of said actuating portion and located on opposite longitudinal sides of said weakened area, said guards being spaced apart a sufficient distance to permit access to said weakened area of said housing only by the front incisors of said user when the actuating portion of housing is positioned in the user's mouth.

2. The switch assembly of claim 1 in which said tubular housing is formed in the shape of an L and in which the handle portion of the housing forms one leg of the L and the actuating portion forms the other leg of the L.

3. The switch assembly of claim 1 in which said guards are ribs formed integrally with said actuating portion of said housing.

4. The switch assembly of claim 1 in which said ribs extend circumferentially of said actuating portion of said housing.

5. The switch assembly of claim 1 in which said blades are held in spaced relation to each other by a resilient, compressible insulator.

6. The switch assembly of claim 1 in which said electric switch is enclosed in rubber which fills said tubular housing.

7. The switch assembly of claim 1 in which said weakened area is obtained by cutting away a portion of said housing.

* * * * *